US006848577B2

(12) United States Patent
Kawamura et al.

(10) Patent No.: US 6,848,577 B2
(45) Date of Patent: Feb. 1, 2005

(54) SMALL ARTICLE CASE

(75) Inventors: Ryoji Kawamura, Taipei (TW); Hiroshi Matoba, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/986,998

(22) Filed: Nov. 13, 2001

(65) Prior Publication Data

US 2002/0056652 A1 May 16, 2002

(30) Foreign Application Priority Data

Nov. 15, 2000 (JP) ..... 2000-347544

(51) Int. Cl.[7] ..... B65D 85/48
(52) U.S. Cl. ..... 206/449; 206/37
(58) Field of Search ..... 206/37, 37.4, 37.5, 206/39, 457, 449, 38, 38.1, 1.5; 150/147, 145, 149; 220/345.1, 345.2, 345.3, 351, 345.4, 326, 787, 788

(56) References Cited

U.S. PATENT DOCUMENTS 193,382 A * 7/1877 Pinney et al. ..... 206/38.1
1,658,496 A * 2/1928 Qvarnstrom ..... 206/38.1
3,600,917 A * 8/1971 Krock ..... 70/459
4,007,828 A * 2/1977 Mayled ..... 206/1.5
4,113,098 A * 9/1978 Howard ..... 206/540
4,126,224 A * 11/1978 Laauwe et al. ..... 206/540
4,284,204 A * 8/1981 Carey, Jr. ..... 220/345.3
4,561,544 A * 12/1985 Reeve ..... 206/540
5,263,577 A * 11/1993 Paratte et al. ..... 206/38.1
5,275,291 A * 1/1994 Sledge ..... 206/531
5,467,871 A * 11/1995 DeField ..... 206/232
6,119,864 A * 9/2000 Kessler et al. ..... 206/704
6,341,710 B1 * 1/2002 Danielson et al. ..... 220/281

* cited by examiner

*Primary Examiner*—Shian T. Luong
(74) *Attorney, Agent, or Firm*—Finnegan, Henderson, Farabow, Garrett & Dunner, L.L.P.

(57) ABSTRACT

The present invention provides a small article case which secures a sufficient engagement strength between a plug-in body and a socket, keeps the engagement strength even if the small article case is repeatedly used, is suitable for containing the small articles, and is easy to use since the plug-in body is easily engaged with and disengaged from the socket from the outside. The small article case is composed of a socket and a plug-in body to be inserted in the socket. The socket comprises a tubular body with a bottom having front and rear wall portions and opposing side wall portions, and a pair of engagement pawl attaching openings cut in arcs from the respective side wall portions to the front and rear wall portions are provided on the bottom side thereof. The plug-in body comprises a picking portion having a section larger than that of an insert hole of the socket, a small article mounting plate portion elongated from the picking portion in the insertion direction of the socket, and a pair of elastic legs which are elongated in the insertion direction at a certain distance from and along at least a front end of the small article mounting plate portion and which have engagement pawls on the outside surfaces thereof.

5 Claims, 7 Drawing Sheets

SMALL ARTICLE CASE

BACKGROUND OF THE INVENTION

1. Field of the Invention

The present invention relates to a small article case comprising a plug-in body and a socket for various small articles such as name cards, various cards, photographs, various tickets, amulets, memo pads, keys, coins, cigarettes and a cigarette butt.

2. Description of the Related Art

Conventionally, for example, a buckle provided with a drawer having a function as a small article case is disclosed in Japanese Utility Model Application Laid-Open No. 61-129509. This buckle is configured by a buckle body comprising a rectangle thin box having a slit-type inlet at one end thereof and a drawer capable of being taken in and out from a hollow portion of the buckle body.

A protrusion is formed toward the inside on a portion of an inner wall surface of the buckle body. The drawer is formed in a shape required for storing the small articles in the hollow portion of the buckle body while the drawer has a concave portion capable of being elastically engaged with and disengaged from the protrusion of the buckle body. Specifically, the drawer is configured by a metal made frame in substantially C-shape composed of a pair of legs with a concave portion on a portion of the respective outside surface, ends of the legs being connected by a connecting bar or a metal plate having a concave portion toward the inside on a portion of a peripheral wall of a rectangular plate.

According to the buckle disclosed in the above described publication, in the case that the drawer is configured by substantially C-shaped metal frame or a rectangular metal plate, the buckle body is elastically engaged with or disengaged from the drawer between the protrusion formed in the inside of the buckle body and the concave portion formed on the legs of the drawer or on the wall of the drawer. Therefore, for this engagement and disengagement, it is necessary that the leg or the wall of the drawer should be slidable in the state that the leg or the wall of the drawer runs on the protrusion formed in the inside of the buckle body upon inserting and taking out of the drawer. As a result, it is necessary to design the drawer in such a manner that the upper and lower legs or the upper and lower walls are capable of being elastically deformed.

Further, in order to smoothly release the engagement of the protrusion and the concave portion after the drawer is engaged with the buckle body, it is not possible to increase the engagement strength thereof without consideration, so that there should be a limit in the engagement strength. Further, upon releasing the engagement to pull out the drawer from the buckle body, the drawer is merely pulled out from the buckle body without performing the operation for releasing the engagement, so that excessive force acts on the buckle body and the drawer. If such releasing is repeatedly performed, abrasion and damage are generated between the protrusion and the concave portion, so that the engagement strength is reduced and the operation for taking in and out of the drawer tends to be unworkable.

SUMMARY OF THE INVENTION

The present invention has been made taking the problem into consideration, and an object of the invention is to provide a small article case in which the sufficient engagement strength between a plug-in body and a socket is secured, the required engagement strength is maintained since it does not get damaged even if it is repeatedly used, the small articles are certainly contained and held and which is easy to use since the plug-in body is easily engaged with and disengaged from the socket from the outside.

In order to solve the above described problem, the present invention provides a small article case composed of a plug-in body and a socket in which the plug-in body is inserted, wherein the socket comprises a tubular body with a bottom having front and rear wall portions and opposing side wall portions and a pair of engagement pawl attaching openings cut in arcs from the respective side wall portions to the front and rear wall portions is provided on the bottom side thereof, and the plug-in body comprises a picking portion having a section larger than that of an insert hole of the socket, a small article mounting plate portion elongated from the picking portion in the insertion direction of the socket, and a pair of elastic legs which are elongated in the insertion direction at a certain distance from and along at least a front end of the small article mounting plate portion and which have engagement pawls on the outside surfaces thereof.

In the case of using a small article case that is constituted as described above, the plug-in body is inserted from a front end side of the small article mounting plate into the insert hole of the socket as elastically deforming the elastic legs to the inside. When an edge of the picking portion of the plug-in body is about to abut against the edge of the insert hole of the socket, the engagement pawls formed on the outside surfaces of the elastic legs of the plug-in body reach to the openings of the socket, the elastic legs are elastically restored to the outside, the engagement pawls are fitted and engaged with the openings while the outside surfaces of the engagement pawls are exposed to the outside.

Since the openings of the socket are formed to be cut toward the inside, when the plug-in body is pulled out of the socket, the engagement pawls exposed from the openings are pushed down to the inside with fingers and the plug-in body is pulled out as releasing the engagement of the openings and the engagement pawls. Such an operation from the outside allows the plug-in body to be easily pulled out from the socket.

Further, since the operation from the outside allows the engagement of the plug-in body and the socket to be certainly released, it is possible to set the engagement strength between the engagement pawls and the openings to the required strength in accordance with the application thereof, for example, by changing the size and the shape of the openings and the engagement pawls and the elasticity strength of the elastic legs, in which these engagement pawls are formed.

Preferably, the plug-in body and the socket are molded articles made of a synthetic resin material. Thus, by using a synthetic resin material and molding the plug-in body and the socket by injection molding or the like, it is possible to produce the small article case according to the present invention at a low cost and the productivity is also improved. For example, polyoxymethylene, polyvinyl chloride, polypropylene, polystyrene, an ABS resin, an acrylic resin and an acetal resin may be used as the synthetic resin material.

Preferably, the small article case has a wall portion on a circumference of the small article mounting plate portion and a shape of a section including the small article mounting plate portion and the wall portion is substantially equal to the section of the insert hole of the socket. Thus, by forming the wall portion on the circumference of the small article mounting plate portion, even when the small articles are mounted and contained in this small article mounting plate portion and the small article mounting plate portion is inserted in the socket, the small articles do not fall from the small article mounting plate portion, so that the operationality upon inserting and pulling out of the plug-in body is improved. Also, in the case that a heat resistance resin is used as the plug-in body having the wall portion, the small article case according to the present invention may be used as an ashtray or the like.

Preferably, one of a guide ridge and a concave groove, which are elongated in the insertion direction of the plug-in body and which are capable of being fitted with each other, is formed on one of a rear surface of the small article mounting plate portion of the plug-in body and the inside face of any one of front and rear wall portions of the socket and the other of the ridge and groove is formed on the other of the rear surface and the inside face. Thus, by forming the guide ridge and concave groove which are capable of being fitted with each other, when the plug-in body is inserted into or pulled out from the socket, fitting of the guide ridge and the concave groove allows the plug-in body to be guided straight against the socket, so that the plug-in body is capable of being inserted in and being pulled out from the socket smoothly.

Further preferably, at least one the front and rear wall portions of the socket is formed by a transparent material. Thus, by forming the front and rear wall portions of the socket with a transparent material, it is possible to see through the small articles contained in the inside from the outside. For example, in the case of storing name cards in the inside, the small article case in which the name cards are contained may be used as a tag holder for a suitcase or the like.

Also preferably, a small article holding pocket in which a portion of the small article is inserted is formed on the small article mounting plate portion of the plug-in body. Thus, by forming such small holding pocket, it is possible to certainly hold the small article and the small articles do not fall from the plug-in body even when the plug-in body is engaged with and disengaged from the socket, so that the engagement and disengaging operation is easily operated. Also, for example, in the case of forming a card holding pocket to hold various cards such as a cash card, a name card and the like or a box type holding pocket to contain and hold a package of cigarettes, a box of candies and the like, it is possible to certainly hold the cards and various boxes in a stable posture.

Preferably, the small article case has a strap attaching hole on at least one of the plug-in body and the socket. Thus, by using such a strap attaching portion, a cord type, a strap type or a loop type strap is attached to the small article case, so that the small article case according to the present invention may be used as being attached to a mobile telephone, a bag and the like or it may be used as being hung from a neck. Alternatively, if the strap attaching portions are formed on the both of the plug-in body and the socket and the opposite ends of the strap are attached to the plug-in body and the socket, respectively, it is possible to hold the small article case with the strap being wounded on a waist of the user.

DESCRIPTION OF THE PREFERRED EMBODIMENTS

Embodiments of the present invention will be specifically explained below with reference to the drawings.

Figure 1:
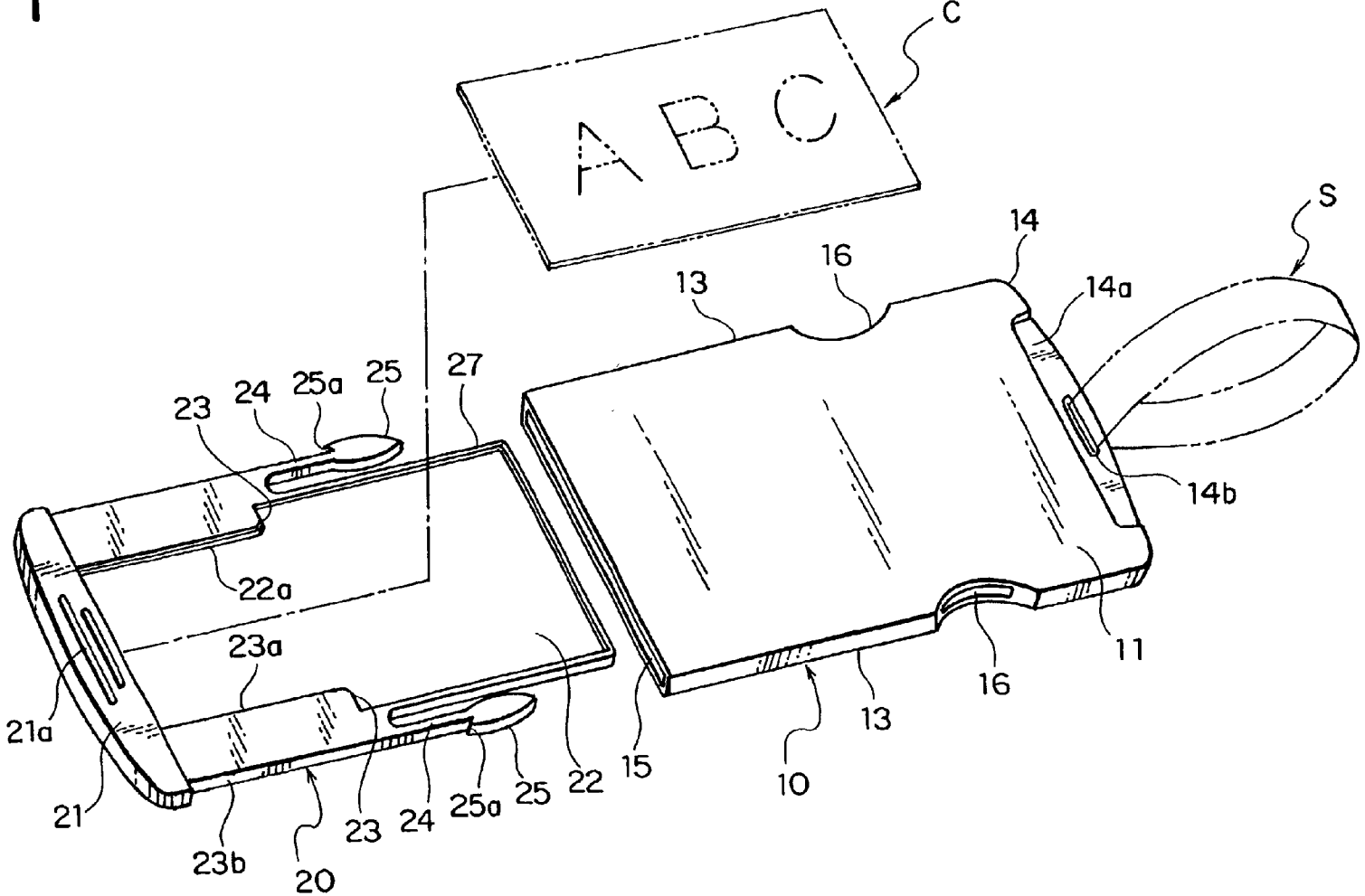
FIG. 1 is a perspective view of a socket and a plug-in body of a small article case according to an embodiment of the present invention.

FIG. 1 is a perspective view of a small article case according to a preferred embodiment of the present invention. The small article case of the present invention is composed of a socket 10 and a plug-in body 20 to be inserted in this socket 10.

Figure 2:
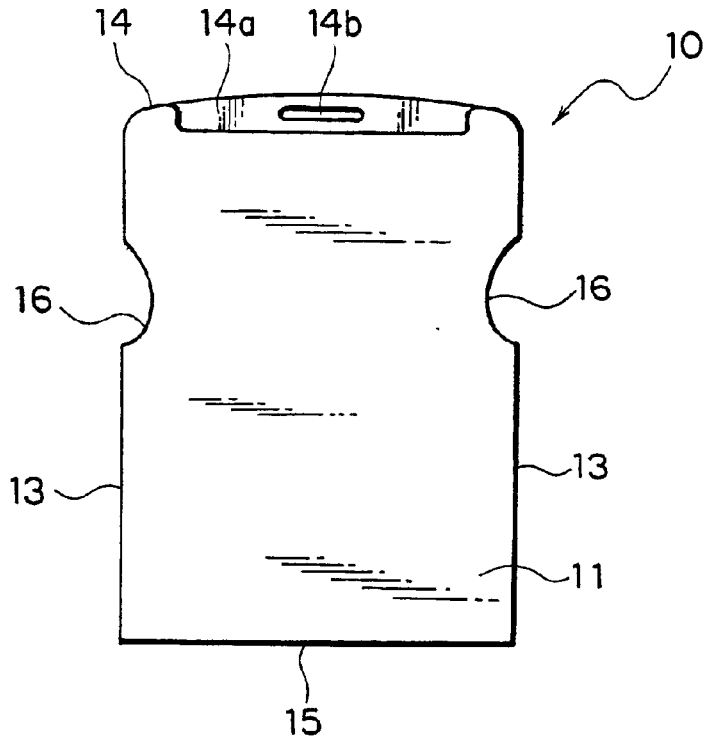
FIG. 2 is a top view of the socket.
Figure 3:
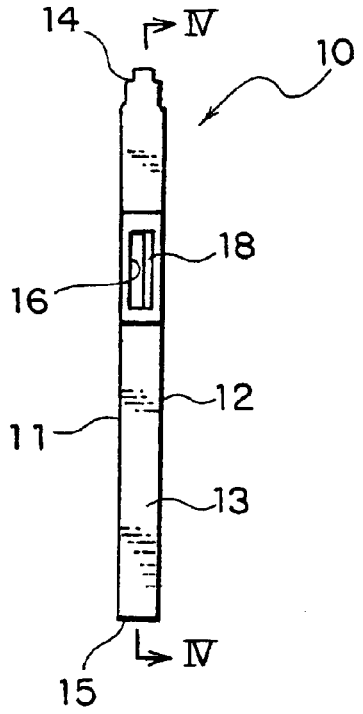
FIG. 3 is a side view of the socket.
Figure 4:
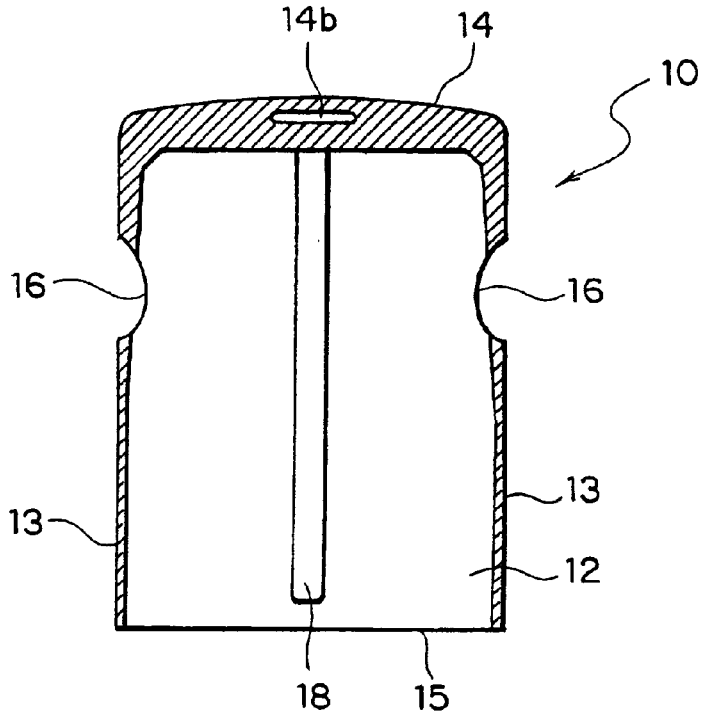
FIG. 4 is a sectional view taken along line IV—IV in FIG. 3.

FIG. 2 is a top view of the socket 10, FIG. 3 is a side view of the socket 10 and FIG. 4 is a sectional view taken along line IV—IV in FIG. 3.

The socket 10 is configured by a tubular body with a bottom having front and rear wall portions 11 and 12, opposing side wall portions 13 and a bottom portion 14. In this tubular body, an end opposite to the bottom portion 14 is open to the outside so that an insert hole 15 of the plug-in body 20 to be described later is formed. Further, in the vicinity of the bottom portion 14 of the socket 10, a pair of engagement pawl attaching openings 16, 16 cut in arcs from the side wall portions 13, 13 to the front and rear wall portions 11 and 12, are provided.

On the bottom portion 14 of the socket 10, a strap attaching portion 14*a*, a portion of which made to be thin toward the outside, is elongated. Further, on this strap attaching portion 14*a*, a strap attaching hole 14*b*, which penetrates from a front side to a rear side of the socket 10, is formed. As shown in FIG. 1, a strap S in a narrow looped band may be attached on this strap attaching hole 14*b*. On the inner surface of the rear wall portion 12 of the socket 10, a guide ridge 18 is formed along a center line, which is elongated in an insertion direction.

Figure 5:
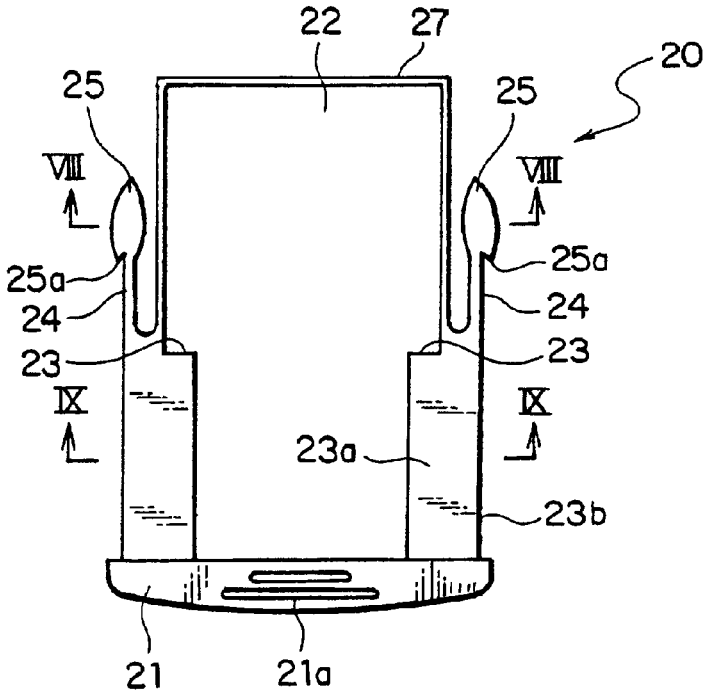
FIG. 5 is a top view of the plug-in body.
Figure 6:
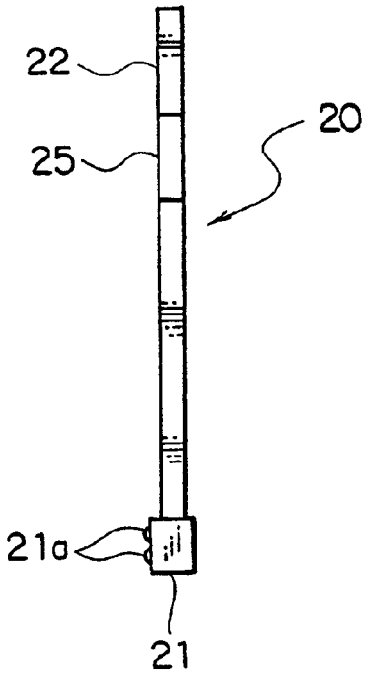
FIG. 6 is a side view of the plug-in body.
Figure 7:
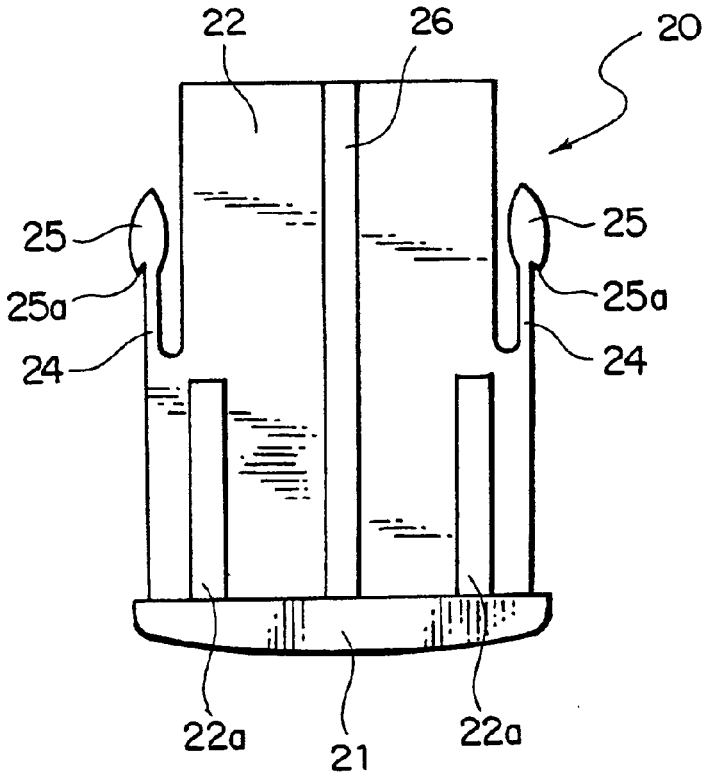
FIG. 7 is a rear view of the plug-in body.
Figure 8:
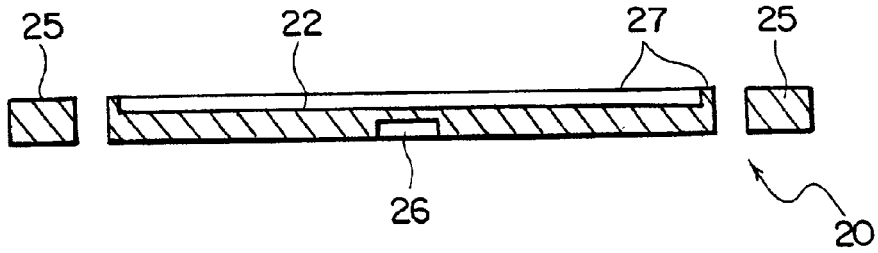
FIG. 8 is a sectional view taken along line VIII—VIII in FIG. 5.
Figure 9:
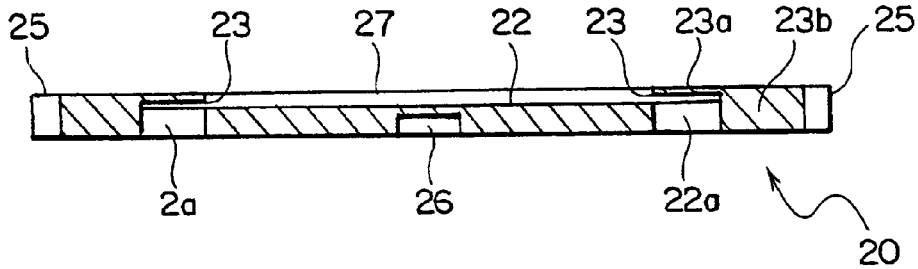
FIG. 9 is a sectional view taken along line IX—IX in FIG. 5.
Figure 10:
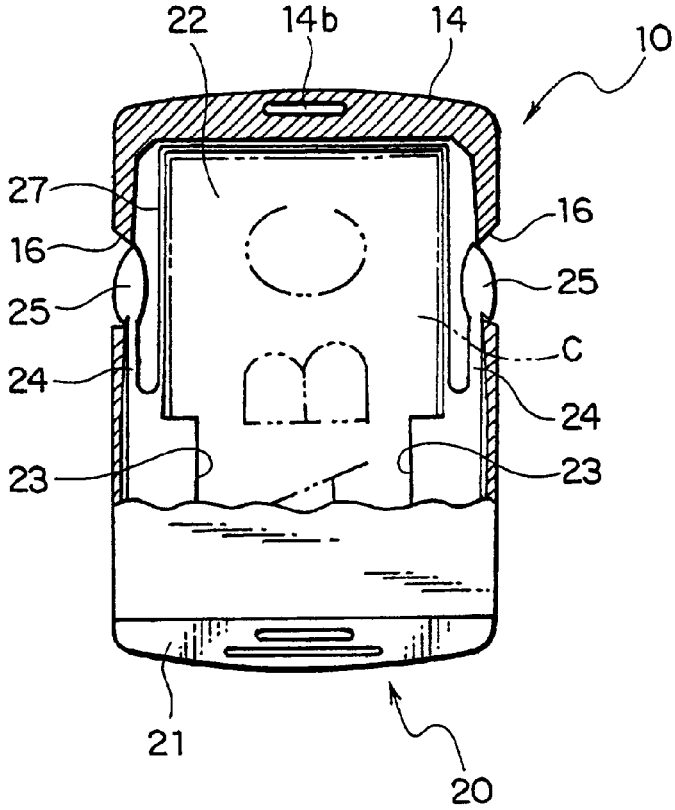
FIG. 10 is a partial broken view for illustrating an interior of the socket and the plug-in body which are engaged according to the embodiment.

FIG. 5 is a top view of the plug-in body 20, FIG. 6 is a side view of the plug-in body 20, FIG. 7 is a rear view of the plug-in body 20, FIG. 8 is a sectional view taken along line VIII—VIII in FIG. 5, FIG. 9 is a sectional view taken along line IX—IX in FIG. 5 and further, FIG. 10 is a partial broken view for illustrating an interior structure of the socket 10 and the plug-in body 20 which are engaged with each other.

The plug-in body 20 is provided with a picking portion 21 composed by a slender substantially rectangular plate on its end and the plug-in body 20 as a whole takes the shape of substantially rectangular plate. The outer periphery of the end face of the picking portion 21 has a shape substantially the same as the size of the outer periphery of the end face of the insert hole 15 of the socket 10. On the other hand, the size of the section of the picking portion 21 is slightly larger than the size of the opening section of the insert hole 15. On a surface of this picking portion 21, a concavo-convex face 21*a* is formed as a slip stopper.

A small article mounting plate portion 22 to mount the small articles is elongated integrally from this picking portion 21 in the insertion direction of the socket 10. The length of the small article mounting plate portion 22 in the insertion direction is set so as to be substantially equal to the length from the insert hole 15 to the inner wall surface of the bottom portion 14 of the socket 10. According to the present embodiment, for example, in order to contain a card C as a small article as shown in FIG. 1, a card holding pocket 23 is formed along a half portions at the side of the picking portion 21 of the opposite sides' circumferences to the corners in the insertion direction of the small article mounting plate portion 22, in which a portion of the card C is inserted and the front and rear surfaces of the card C are clipped and held. The card holding pocket 23 is composed of a card face holding portion 23*a* which is disposed in parallel with the small article mounting plate portion 22 and holds the surface of the card C and a coupling wall portion 23*b* which couples respective outer edges of this card face holding portion 23*a* and the small article mounting plate portion 22. A section of the card holding pocket 23 takes a lateral L-shape and the inside thereof is opened. Further, on the circumference of a half portion at the side of the insertion edge of the small article mounting plate portion 22, a circumferential wall portion 27 is formed. The circumferential wall portion 27 has a height only enough for holding the card C.

On the portion corresponding to card holding pocket 23, of the small article mounting plate portion 22, a window hole 22*a* having the substantially same area as that of the pocket 23 is formed. Accordingly, the rear face side of the card holding pocket 23 becomes an inner wall surface of the L-shape. Also, the outer surfaces of the right and left coupling wall portions 23*b* of the card holding pockets 23 are protruded from right and left of the small article mounting plate portion 22 and a size between the outer surfaces of right and left coupling wall portions 23*b* is set to be substantially equal to the opening width of the insert hole 15 of the socket 10.

Further, a pair of elastic legs 24, 24 are elongated in the insertion direction from the protrusions of the right and left coupling wall portions 23*b* of the card holding pockets 23 at a predetermined distance from the small article mounting plate portion 22 on the right and left sides interposing the half portion of the small article mounting plate portion 22 at the insertion edge side. Engagement pawls 25, 25 expanding to the outside, respectively, are disposed on distal ends of the respective elastic legs 24, 24. The lengths of these elastic legs 24, 24 are set so that the engagement pawls 25, 25 come to positions of the engagement pawl attaching openings 16, 16 of the socket 10 when the plug-in body 20 is inserted in the socket 10. According to the present embodiment shown in the drawings, lengths of these elastic legs 24, 24 are set to be substantially ¼ of the length of the small article mounting plate portion 22.

The engagement pawls 25, 25 are substantially spindle-shaped from two-dimensional view. Pawl portions 25*a*, 25*a* are formed on the outer edges on the side of the picking portion 21. When the plug-in body 20 is inserted in the socket 10, the respective pawl portions 25*a*, 25*a* of the engagement pawls 25, 25 are engaged with the side wall edges of the engagement pawl attaching openings 16, 16 on the side of the insert hole 15. Further, a concave groove 26 is formed along a center line, which is elongated in the insertion direction of this small article mounting plate portion 22, on a rear center portion of the small article mounting plate portion 22. The guide ridge 18 of the socket 10 is fitted with this concave groove 26.

Further, according to the present embodiment, thickness and right and left width of the plug-in body 20 are set to be fitted with a space in the socket 10 for insertion so that the plug-in body 20 does not rattle when the plug-in body 20 is inserted in the socket 10. In other words, the sizes in front-rear direction of the card holding pockets 23, the leg portion 24 and the wall portion 27 on the forgoing small article mounting plate portion 22 are set so as to be equal to the height of the insert hole 15 of the socket 10 and the right and left widths of the card holding pockets 23 and the leg portions 24 are set so as to be equal to the width of the insert hole 15.

The socket 10 and the plug-in body 20 can be molded by injection molding by using, for example, polyoxymethylene, polyvinyl chloride, polypropylene, polystyrene, an ABS resin, an acetal resin, an acrylic resin, polycarbonate, polyurethane, polyamide, polyester and the like.

When the plug-in body 20 of the small article case is inserted from the insert hole 15 of the socket 10, the guide ridge 18 of the socket 10 is fitted with the concave groove 26 of the plug-in body 20 and the concave groove 26 is guided by the guide ridge 18, so that it is possible to smoothly insert the plug-in body 20 in the insert hole 15 of the socket 10 while guiding it along the side wall portions 13, 13 of the socket 10.

In this case, the elastic legs 24, 24 of the plug-in body 20 move within the socket 10, being elastically deformed to the inside. At the same time that the end face of the picking portion 21 of the plug-in body 20 abuts against the edge of the insert hole 15 of the socket 10, the engagement pawls 25, 25 of the elastic legs 24, 24 reach the engagement pawl attaching openings 16, 16 of the socket 10 and the elastic legs 24, 24 elastically restore their original positions. Then, as shown in FIG. 10, the engagement pawls 25, 25 are engaged with the engagement pawl attaching openings 16, 16 of the socket 10 with a portion thereof being exposed to the outside. In this case, according to the present embodiment, the pawl portions 25*a*, 25*a* of the engagement pawls 25, 25 are engaged with the edges of the engagement pawl attaching openings 16, 16, so that a strong engagement is realized.

In the case of pulling out the plug-in body 20 of the small article case, when the user pulls out the picking portion 21 of the plug-in body 20 as pushing the portions of the engagement pawls 25, 25 exposed from the engagement pawl attaching openings 16, 16 of the socket 10, to the inside with fingers, the elastic legs 24, 24 are elastically deformed to the inside and the engagement pawls 25, 25 are pushed from the engagement pawl attaching openings 16, 16 to the inside, so that the engagement of the engagement pawls 25 and the engagement pawl attaching openings 16 is released. In this state, if the plug-in body 20 is further pulled out, it is possible to easily pull out the plug-in body 20 from the socket 10. In the case of pulling out this plug-in body 20, the concave groove 26 of the plug-in body 20 is guided by the guide ridge 18 of the socket 10 so as to be smoothly pulled out.

As described above, according to the present embodiment, the engagement of the socket 10 and the plug-in body 20 is performed by the engagement of the engagement pawls 25 formed on the elastic legs 24 of the plug-in body 20 and the engagement pawl attaching openings 16 cut in arcs from the side wall portion 13 to the front and rear wall portions 11 and 12 of the socket 10, so that, by arbitrarily changing the shapes of the engagement pawls 25 and the engagement pawl attaching openings 16, it is possible to arbitrarily change the strength of the engagement between them. And, unless the engagement pawls 25 are positively operated from the engagement pawl attaching openings 16, the plug-in body 20 is not easily removed out from the socket 10.

In order that the engagement pawls 25 are not carelessly pushed from the engagement pawl attaching openings 16 in the interior of the socket 10 while the engagement pawls 25 are not positively operated, it is preferable that the shapes and the sizes of the engagement pawls 25 are set so that the outside surfaces of the engagement pawls 25 are not protruded from the socket 10 to the outside when they are engaged with the engagement pawl attaching openings 16. When the user intends to positively pull out the plug-in body 20 from the socket 10, pushing the engagement pawls 25 exposed from the engagement pawl attaching openings 16 allows the engagement to be easily released, so that the plug-in body 20 is easily pulled out.

Thus, by appropriately designing the elastic deformation of the elastic legs 24 and the sizes of the engagement pawls 25, the strength of the engagement between the engagement pawls 25 and the engagement pawl attaching openings 16 is set to be a desirable value and it is possible to optimize the engagement and disengagement operation of the socket 10 and the plug-in body 20. Further, even if the socket 10 and the plug-in body 20 are repeatedly used, the elasticity of the elastic legs 24 is not lowered, so that a desirable strength of the engagement can be maintained for a long period.

Further, particularly, in the case of using the small article case of the present invention as the card holder as described above, by making the front wall portion 11 of the socket 10 of a transparent resin material or by forming the window portion on the front wall portion 11, it is possible to see the card inside from the outside, so that the small article case is preferably used as a tag holder.

Figure 11:
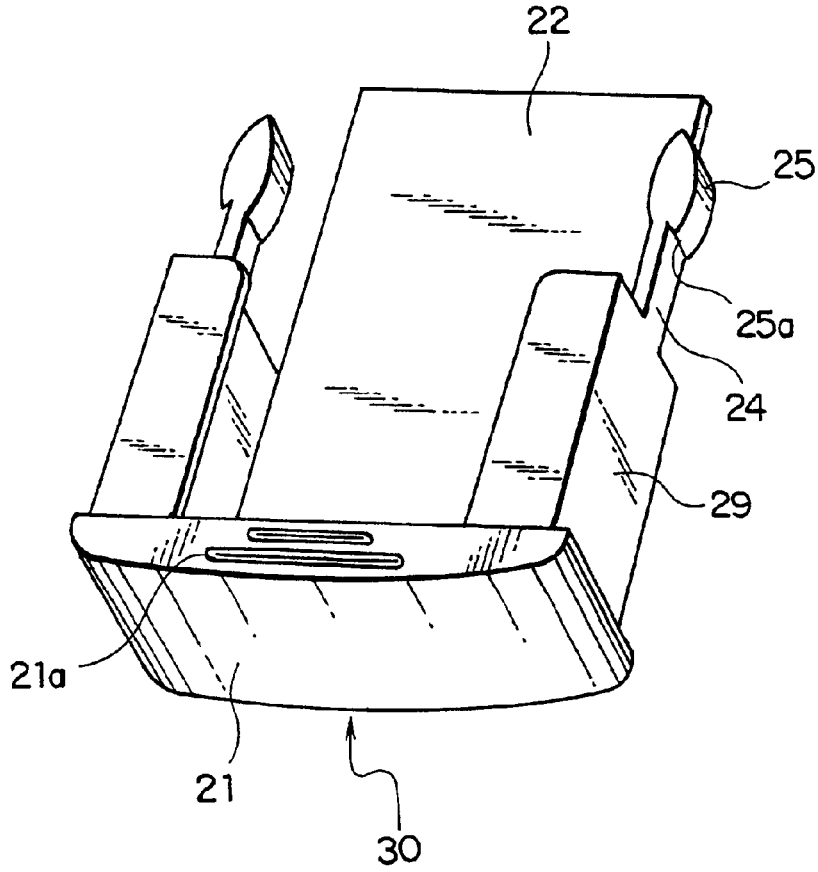
FIG. 11 is a perspective view of a plug-in body according to a modification of the embodiment.

Further, the space between the front and rear wall portions 11 and 12 of the socket 10 is capable of being set to a desirable size. By widening this space and, as a plug-in body 30 shown in FIG. 11, at least forming a tall box holding pocket 29 along the edges of the opposite sides of the half portion of the small article mounting plate portion 22 on the picking portion 21 side along the insertion direction, it is possible to contain and hold the small articles such as a package of cigarettes, a box of candies and the like. Alternatively, for example, in the case that the window hole 22*a* is not formed, it is possible to contain the small articles such as keys, coins and the like.

Figure 12:
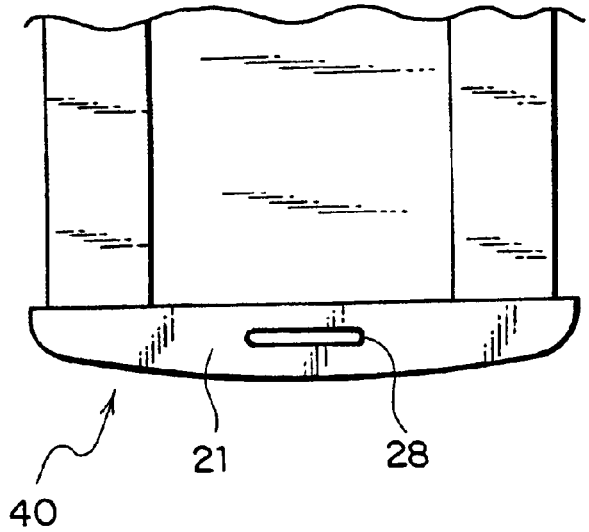
FIG. 12 is a top view for illustrating a portion of a plug-in body according to another modification of the embodiment.

Additionally, as a plug-in body 40 shown in FIG. 12, the small article case may be used with a strap attaching hole 28 formed on the picking portion 21, and the plug-in body 40 and the socket 10 being attached on the opposite ends of one strap.

Figure 13:
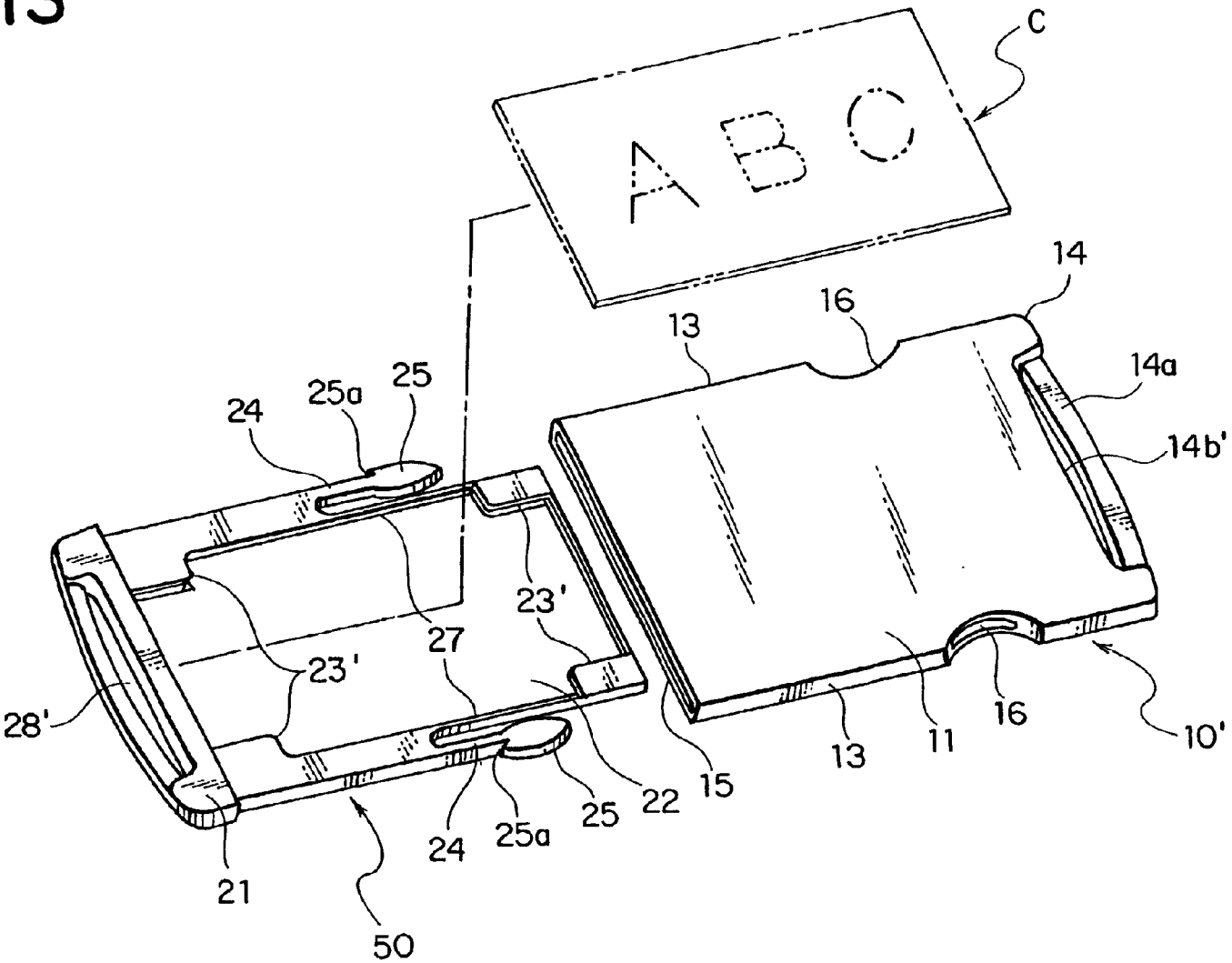
FIG. 13 is a perspective view of the socket and the plug-in body according to still another modification of the described embodiment.

Further, according to the small article case shown in FIG. 13, strap attaching holes 28' and 14*b*' in long slit shapes, through which a wide tape type strap may be threaded, are formed on a plug-in body 50 and a socket 10', respectively. When the plug-in body 50 and the socket 10' are attached to the opposite ends of the wide tape-like strap, respectively, by using the strap attaching holes 28' and 14*b*' in long slit shapes, it is possible to fasten a waist of the user by the strap as a belt as well as to fix the small article case on the waist of the user or the like.

Further, according to the plug-in body 50 shown in FIG. 13, card holding pockets 23' are formed on the both sides of the opposite edges of the small article mounting plate portion 22 on the side of the picking portion 21 and on the side of the plug-in edge, respectively, along the insertion direction of the small article mounting plate portion 22 with a length substantially ⅕ of the length of this direction. On the remaining circumference, a low circumferential wall portion 27 is formed. Thus, if the card holding pockets 23' are formed on the both sides of the opposite edges of the small article mounting plate portion 22, that is, on the side of the picking portion 21 and on the side of the plug-in edge, four corners of the card C are clipped and held, so that the card C does not slide off from the small article mounting plate portion 22 and it is possible to locate and hold the card C further reliably.

What is claimed is:

1. A small article case composed of a socket and a plug-in body to be inserted in said socket, wherein said socket comprises a tubular body with a bottom having front and rear wall portions and opposing side wall portions, and a pair of engagement pawl attaching openings cut in a range from said respective side wall portions to said front and rear wall portions are provided on a side of the side wall portions;

said plug-in body comprises a picking portion having a section larger than that of an insert hole of said socket, a small article mounting plate portion elongated from said picking portion in an insertion direction of said socket, said small article mounting plate portion having a wall portion at least at a part of a periphery of said plug-in body, and a pair of elastic legs which are elongated in the insertion direction at a certain distance from and along at least a front end of said small article mounting plate portion and which have engagement pawls on the outside surfaces thereof; and a small article holding pocket at least partially defined by a small article holding portion, said small article holding portion extending inwardly from an edge portion of said small article mounting plate portion and extending over at least a portion of said small article mounting plate portion, whereby a small article is capable of being mounted on said small article mounting plate portion, and whereby said small article holding pocket is capable of receiving at least a part of said small article between said small article mounting plate portion and said small article holding pocket itself and holding a part of a surface of said small article at a side opposite to said small article mounting plate portion.

2. The small article case according to claim 1, wherein said socket and said plug-in body are molded articles made of a synthetic resin material.

3. The small article case according to claim 2, wherein at least one of said front and rear wall portions of said socket is formed by a transparent material.

4. The small article case according to claim 1, wherein a guide ridge which is elongated in an insertion direction of said plug-in body is formed on one of a rear surface of said small article mounting plate portion of said plug-in body and an inside face of any one of the front and rear wall portions of said socket, and a concave groove, which is elongated in the insertion direction of the plug-in body and capable of being fitted with the guide ridge, is formed on the other one of the rear surface of the small article mounting plate portion of the plug-in body and the inside face of any one of the front and rear wall portions of the socket.

5. The small article case according to claim 1, comprising a strap attaching hole on an edge portion of at least one of said socket and the plug-in body.

* * * * *